United States Patent [19]

McCarter et al.

[11] 3,944,996

[45] Mar. 16, 1976

[54] TELEMETRY ALARM SYSTEM

[75] Inventors: Michael K. McCarter; Dale J. Green, both of Salt Lake City, Utah

[73] Assignee: Kennecott Copper Corporation, New York, N.Y.

[22] Filed: Aug. 5, 1974

[21] Appl. No.: 494,607

[52] U.S. Cl. ..... 340/282; 340/164 R; 340/171 PF

[51] Int. Cl.[2] ..... G08B 7/06

[58] Field of Search ..... 340/203, 271, 282, 421, 340/181, 167 A, 164 R, 171 PF

[56] References Cited

UNITED STATES PATENTS

| | | | |
|---|---|---|---|
| 3,634,824 | 1/1972 | Zinn | 340/167 A |
| 3,750,130 | 7/1973 | Lute | 340/271 X |
| 3,796,959 | 3/1974 | Mackenzie | 340/167 A |

*Primary Examiner*—Harold Pitts
*Attorney, Agent, or Firm*—Mallinckrodt & Mallinckrodt

[57] ABSTRACT

A telemetry system adapted to monitor earth slope stability comprises a minimum of one earth slope stability sensor connected with timing means, which, upon the sensing of slope instability, initiates transmission of a timed signal of a predetermined carrier frequency, and a superimposed tone frequency, by an associated transmitter. A receiver picks up the transmitted signal along with stray signals and feeds all such received signals to a decoder which produces corresponding pulses. The pulses from the decoder enter a time gate circuit, which determines if the time durations of the respective pulses fall within predetermined maximum and minimum limits and which also produces an output signal if a pulse is within such limits. The output signal is used for alarm purposes.

It is ordinarily desired to simultaneously monitor several sites of possible earth slope instability. For this purpose, several sets of stability monitors, timers, and transmitters are provided. Each transmitter is adapted to superimpose an additional tone frequency signal upon the transmitted signal, none of which additional tone signals are alike. The received signals are also sent to a series of identifiers, each of which has an alarm associated therewith and is adapted to produce an output if a predetermined additional tone frequency signal is present. If an output is generated by both the identifier and the time gate circuit, alarm activating means is energized to give an alarm that indicates in which area the slope instability has occurred.

12 Claims, 9 Drawing Figures

TELEMETRY ALARM SYSTEM

BACKGROUND OF THE INVENTION

1. Field:

This invention is in the field of telemetry alarm systems in which a sensor is located at a site remote from the alarm center and in which the signal from the sensor is supplied to the alarm center via telemetry transmissions. In particular, the alarm system of the invention is adapted for use by the mining and related industries to continuously monitor slope stability, especially in open-cut operations such as in the surface mining of copper, so that instances of slope instability will be indicated at an alarm center.

2. State of the Art:

Many different types of telemetry alarm systems are presently known, but none are adapted to monitor slope stability. Some of the known systems are provided with means to discriminate between valid and invalid information at the receiver by imposing a minimum time limitation that must be met before a received transmission is deemed valid. In some, one or more tone signals are superimposed upon the transmitted signal to indicate a valid signal.

SUMMARY OF THE INVENTION

The present invention was developed as an alarm system for an open-pit mine to provide warning at a central location if ground instability occurs within a monitored area of the mine.

A problem was encountered in attempting to use conventional telemetry systems for the purpose, in that there are many stray signals within a mine area that set off the alarm. Even with conventional tone coding and the imposition of a minimum time restriction, the problem of false alarms was shown to be serious.

According to the invention, at least one slope stability sensor is connected to a timer which, in turn, energizes a transmitter for a predetermined length of time. Thus, a timed transmission of a predetermined carrier, and a superimposed, tone frequency is carried out upon the sensing of an alarm condition. If more than one set of sensor, timer, and transmitter are used, an additional or second tone frequency is preferably superimposed upon the carrier and first tone frequency for transmitter-location purposes.

A receiver at a central location receives all signals of transmitter carrier frequency. The received signal enters a decoder, which produces an output pulse proportional in duration to the duration of the first tone frequency of the received transmission. This pulse is then evaluated in a time gate circuit that determines whether or not the pulse falls within certain preset maximum and minimum time limitations. If the pulse falls within the limitations, an output signal from the time gate is produced. This output signal may operate alarm means, but where a second tone frequency has been superimposed on the first, the signal from the receiver enters an identifying means as well as the decoder. The identifying means produces an output if a second predetermined tone frequency is present. Alarm activation means are provided to activate the alarm if both a signal from the time gate and a signal from the identifying means occur simultaneously.

Usually, a multiplicity of sensor, timer, and transmitter sets will be provided, each transmitter superimposing a different second-tone frequency upon the transmitted signal. An equal multiplicity of identifying means will then be provided at the receiver, each identifying means operating a different alarm activating means which will, in turn, operate a different alarm if both the signal from the time gate and the signal from the identifying means are present simultaneously. In this way, the particular transmitter sending the signal can be identified and the particular area of slope instability is known.

THE DRAWINGS

An embodiment presently contemplated as the best mode of carrying out the invention is illustrated in the accompanying drawings, in which:

FIG. 1 is a block diagram of an entire multi-set system, but limited to three sensor, timer, transmitter sets for convenience of illustration;

FIG. 2, a side elevation of a slope stability sensor as used with the system;

FIG. 3, a perspective view of the stability sensor of FIG. 2 with cover removed;

FIG. 4, a schematic of the timer circuitry;

FIG. 5, a combination block diagram and schematic of the receiver-output portion of the system;

FIG. 6, a combination block diagram and schematic similar to FIG. 5, but showing in schematic form some of the blocks indicated in FIG. 5;

FIG. 7, a block diagram of the time gate;

FIG. 8, a schematic of the time gate circuitry;

FIG. 9, a timing diagram showing real time relationships between signals produced by various components of the time gate circuitry.

DETAILED DESCRIPTION OF THE ILLUSTRATED EMBODIMENT

As illustrated, the system of the invention embodies three sensor, timer, transmitter sets for monitoring slope stability. Although only three sets are shown, it should be realized that as many sets as required to monitor a given slope area can be used and in some instances only a single set may be used.

Figure 1:
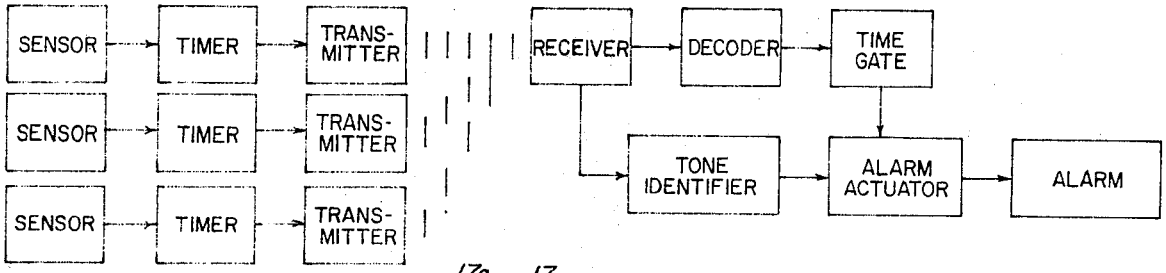
Figure 2:
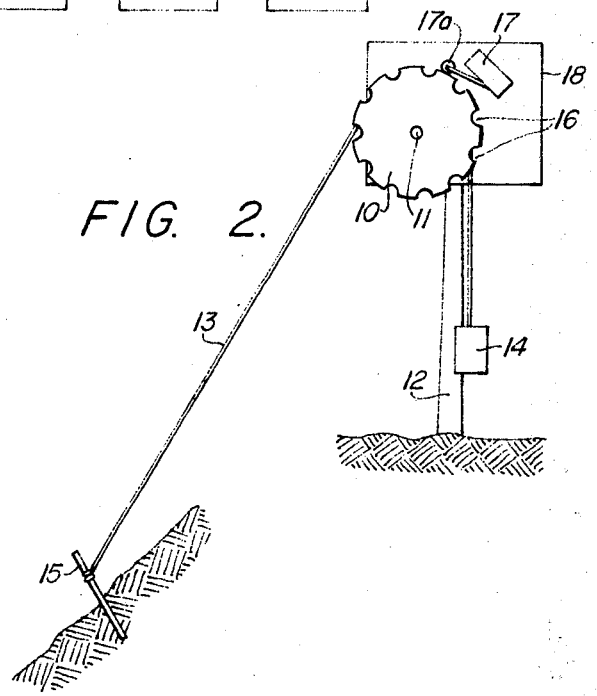
Figure 3:
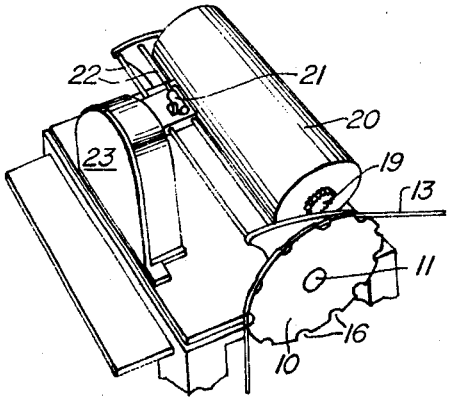

The overall arrangement of the system is indicated by FIG. 1, and an effective stability sensor is shown in FIGS. 2 and 3.

The illustrated sensor is a device known as a "Steven's Recorder" generally used for measuring water levels in wells. It is modified for the present purpose and is set up on stable ground with its sensing probe applied to the slope area to be monitored. It comprises a pulley 10 mounted by axle 11 on a base support 12. A cable 13 is wrapped around the pulley 10, one end being attached to a weight 14 and the other end to a sensing probe in the form of a stake 15 driven into the unstable ground to be monitored. If and when the unstable ground slides, the stake slides with it and pulls the cable, which rotates the pulley.

The outer rim of the pulley has grooves 16 at circumferentially equal spacings. The presently preferred spacing is one groove per inch. A micro-switch 17 is attached to a cover 18 so that its roller **17*a* rides along the outer rim of the pulley 10. While the roller is positioned against the rim, micro-switch 17** is held in its closed position. When the pulley rotates so that a groove reaches the roller and the latter goes down into the groove, the micro-switch is placed in its open positon. As the pulley continues to turn, the roller rides out of the groove and returns the micro-switch to its closed position.

The sensor shown is also a recorder, which keeps a graphical record of slope movement. Such a continuous record of slope movement is valuable in mine stability and safety studies and important for future mine planning and operation.

The standard Steven's Recorder, FIG. 3, comprises pulley 10 attached through gearing 19 to recording drum 20. Thus, as pulley 10 turns, drum 20 also rotates. A pen 21 rests in writing position against the recording drum and is slidably mounted on slideway 22. A mechanical clock 23 causes pen 21 to traverse the slideway at a constant rate. Recording paper is generally placed on the recording drum and changed periodically so that a permanent record of ground movement versus time is kept.

Since the unstable ground to be monitored is usually constantly moving at a very slow rate, present practice is to set the sensor so that the roller of the micro-switch is a distance away from a groove equal to the normal distance that the ground would move in about a two-day period. The sensor is then reset every other day. If the ground movement is faster than expected, the pulley will move so that the micro-switch roller will encounter a groove and cause an alarm to be set off in the manner described below. If the rate of travel of the unstable ground is fast enough, several grooves may be encountered by the micro-switch roller. There are, of course, other types of sensors that may be used to measure the stability of the monitored slope.

Figure 4:
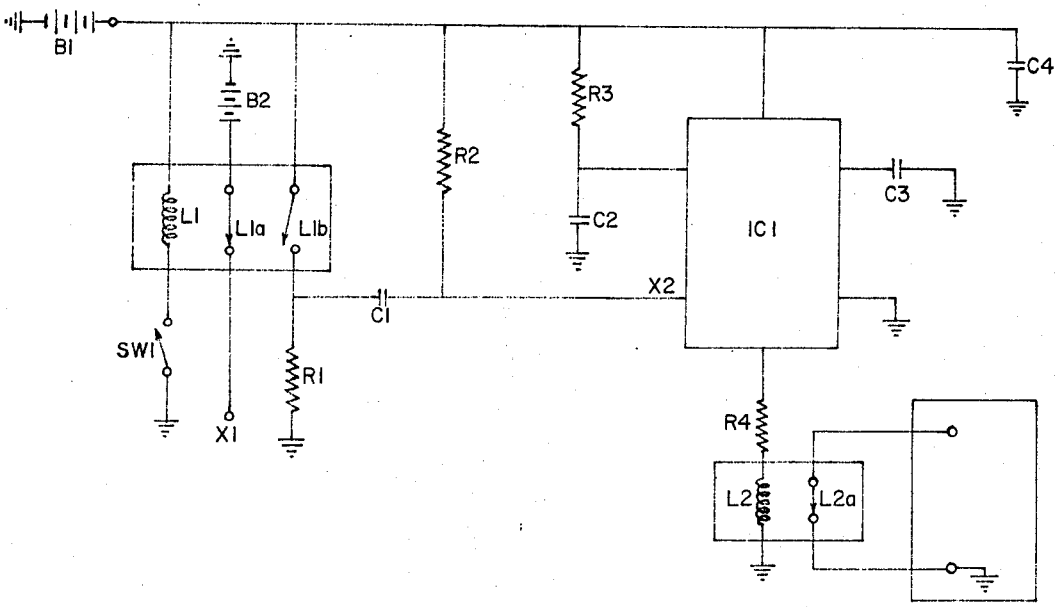

Referring to FIG. 4, the micro-switch of the detector is shown as SW1. This switch is, under normal conditions, closed so that current will flow from battery B1 through relay coil L1 and micro-switch SW1 to ground. A normally closed relay contact L1*a* and a normally open relay contact L1*b* are held in open and closed position, respectively, while coil L1 is energized.

When switch SW1 is opened (micro-switch roller goes into a groove), relay coil L1 is deenergized, relay contact L1*a* is closed, and contact L1*b* is opened. The closing of contact L1*a* connects 7.5 volt battery B2 to terminal X1. The opening of contact L1*b* initiates the timing of integrated circuit timer IC1 in the following manner. With L1*b* closed, there is no charge on capacitor C1 and a potential of 12 volts exists at the terminal X2 of IC1. When contact L1*b* opens, resistors R1 and R2 act as a voltage divider while capacitor C1 charges. The voltage present on terminal X2 of IC1 will drop from 12 volts when L1*b* is closed to a much lower value when L1*b* is opened, and will then, again, increase to 12 volts as capacitor C1 charges. The resistance value of R2 is generally made large compared to that of R1 so that the voltage on terminal X2 of IC1 drops below one volt upon the opening of contacts L1*b*. A negative-going pulse (one that drops from 12 volts to less than 1 volt) thus occurs at terminal X2 upon opening of contacts L1*b*, and the timing cycle of IC1 is begun.

Normally, a path to ground exists internally, through IC1, grounding resistor R3 and holding both ends of capacitor C2 at ground. When a negative-going pulse (such as the one described above) is applied at the trigger input X2 of IC1, the internal grounding circuit is opened and capacitor C2 begins to charge. The rate of charge is determined by the time constant of R3 and C2. When the charge on C2 reaches a value equal to two-thirds the supply voltage, the internal ground circuit closes and the timing cycle of IC1 is over. The supply voltage here is 12 VDC from battery B1. The output of IC1 is a positive pulse lasting for the period of the timing cycle. The output is connected to relay coil L2 through current limiting resistor R4 and causes normally open relay points L2*a* to close for the duration of the timing cycle. Relay points L2*a* are connected to the remote start-stop terminals of a standard transmitter and causes the transmission of a signal during the time the relay contact L2*a* is closed. Power for the transmitter is provided by battery B2 through relay points L1*a*. The transmitter is connected to terminal X1. Capacitor C3 and C4 are filter capacitors for IC1. The transmitter is a standard General Electric Type PE56RAU, transmitting a tone signal of 2100 Hz superimposed on a carrier frequency of 154.6 MHz. It is presently preferred, because several of these transmitters and associated timers and instability sensors will usually be used at various places within the mine, that the transmitter also provide a second frequency tone signal superimposed upon the transmitter frequency. The second tone frequency should be different for each transmitter, as for example, for the three transmitters shown in FIG. 1, the superimposed second tone frequency might be 100 Hz, 200 Hz, and 300 Hz, respectively. The second tone frequency is used to identify the particular transmitter sending the signal, thus locating the site of unstable ground.

Figure 5:
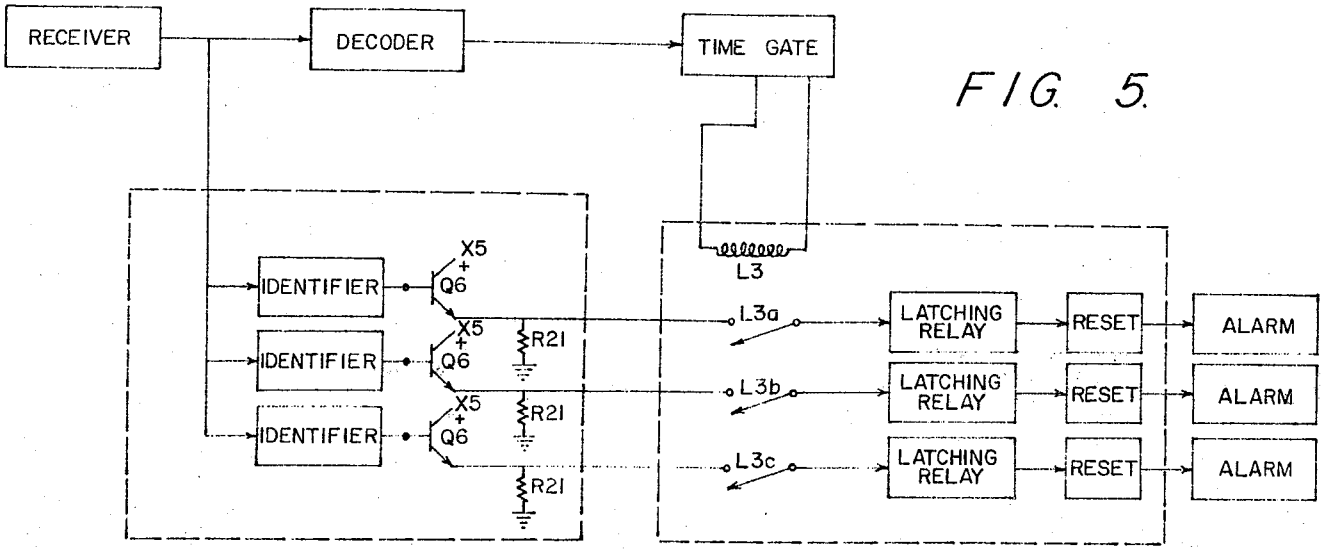

Referring to the block diagram of FIG. 1, and the partial schematic of FIG. 5, a standard receiver such as a General Electric Model 4ER41C11 (including an associated power supply such as a General Electric Model 43P39A11, both being referred to as the receiver herein and in the drawings) pick up all signals of the desired transmitter frequency (154.6 MHz in this particular example). The signals picked up include many stray and unwanted signals along with the signals that may be transmitted by one of the system's transmitters.

The received signals are fed to a standard decoder such as a General Electric Type 90 which produces a 13.5 VDC pulse of duration proportional to the duration of the 2100 Hz tone signal superimposed on the received signal. This pulse from the decoder enters a time gate circuit which determines whether or not the pulse is within preset maximum and minimum time duration limitations. If the pulse is within the limitations, an output from the time gate is produced.

The maximum and minimum time limitations of the time gate are set so that a received signal from one of the system transmitters, which, as described above, is a timed transmission, falls within the maximum and minimum values. The limits are set on either side of the duration of the transmitted pulse so that small variations that may occur will still produce an output at the time gate. It is very unlikely that a random or stray signal received by the receiver will have a tone signal of the correct frequency and that such tone frequency will be of duration within the limitations set by the time gate. For random or stray signals, therefore, output from the time gate is rare. In this way, the system will respond to signals from its transmitters; but the possibility of responding to a stray or random signal is slight. The incidence of false alarms is thus reduced to almost zero.

Figure 7:
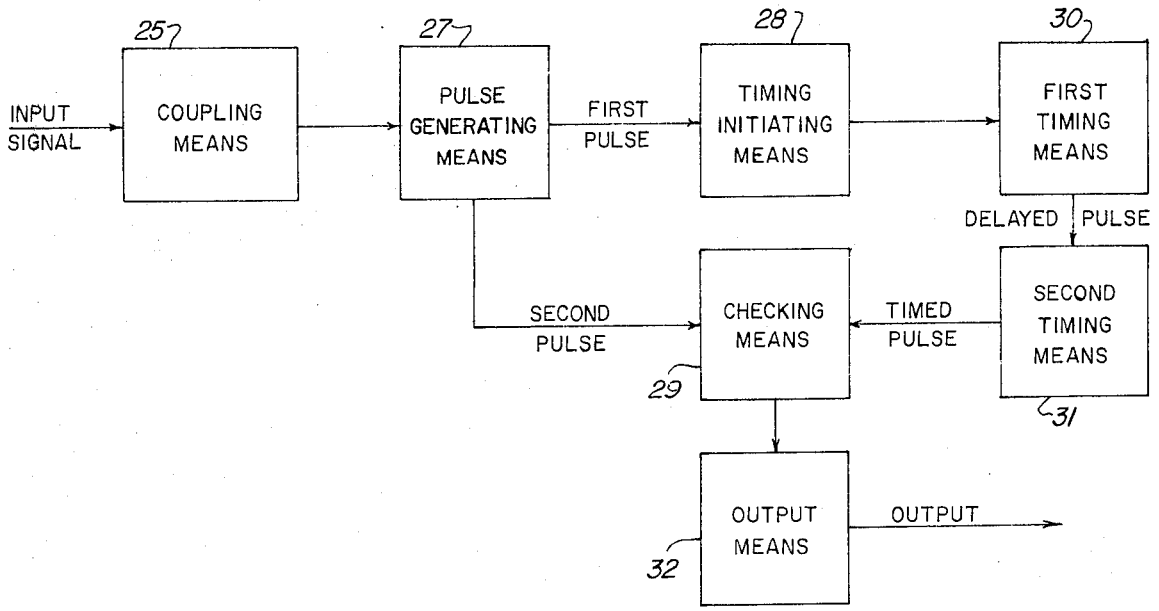
Figure 9:
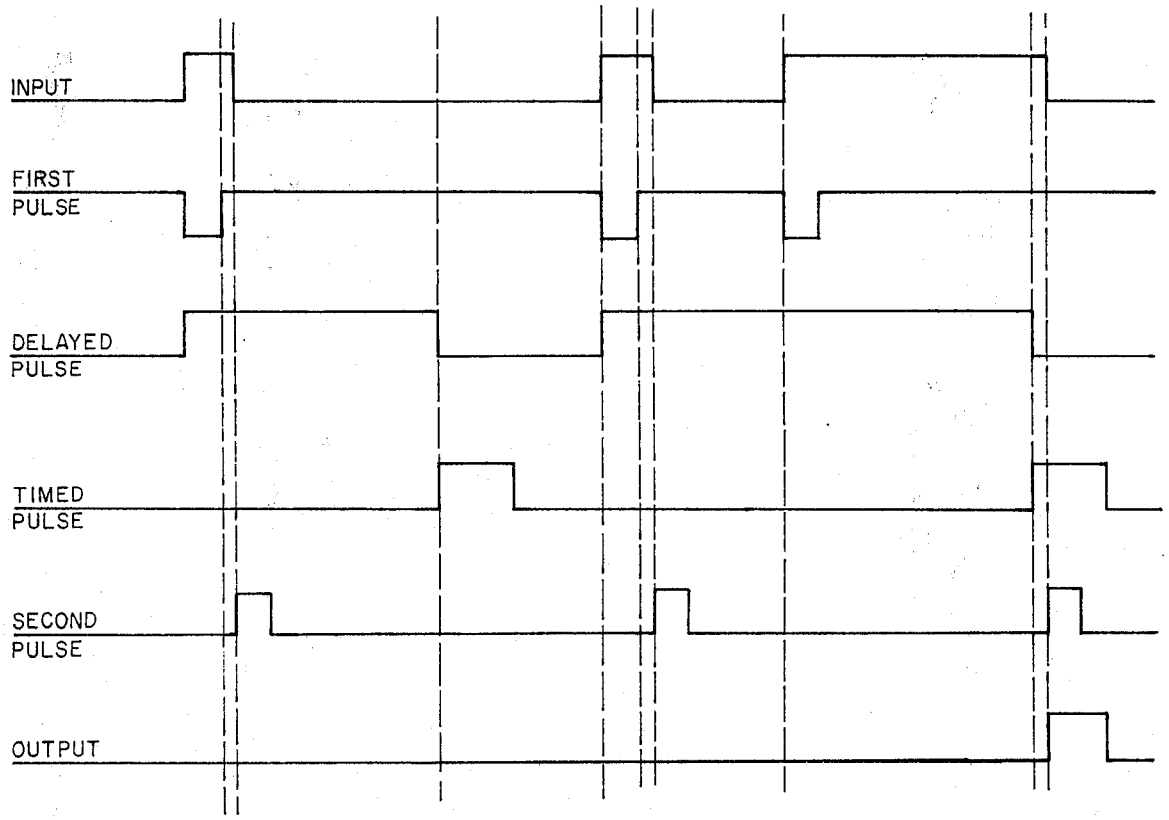
Figure 8:
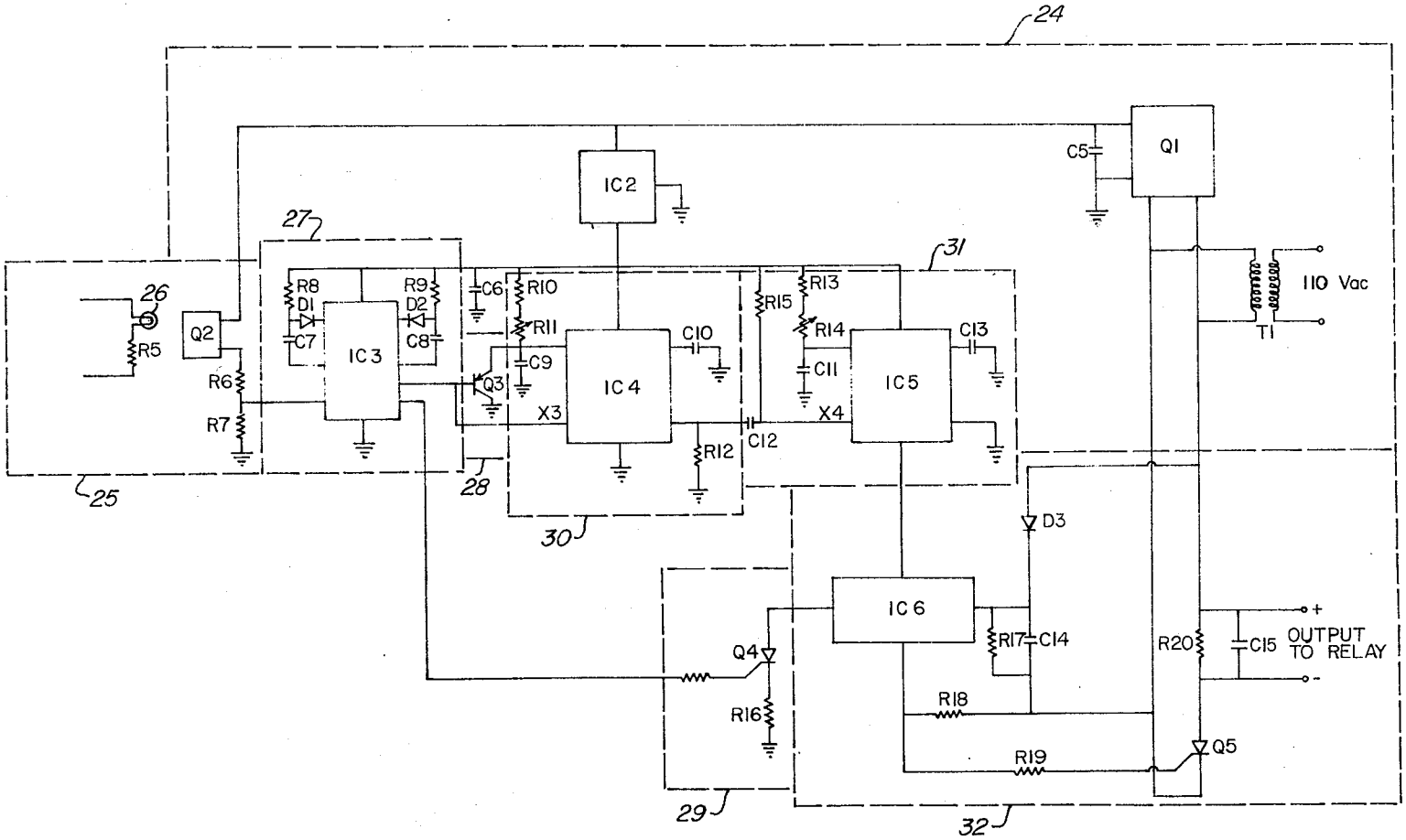

The operation of the time gate circuitry may be understood by reference to FIGS. 7, 8, and 9.

The illustrated circuitry is powered by a power supply, shown in FIG. 8, at 24, but not indicated in FIG. 7. A transformer T1 reduces the usual line voltage from 110 VAC to 12.6 VAC, which is then rectified by full wave rectifier Q1 producing a voltage across capacitor C5 of 15 VDC. 1C2, an integrated circuit voltage regulator, reduces the 15 VDC across C5 to a regulated 5 VDC. The regulated 5 VDC powers most of the integrated circuits in the circuit. Capacitor C6 acts as a filter. The three voltages available, i.e., 12.6 VAC, 15 VDC, and regulated 5 VDc, are all used for different portions of the circuitry as will be indicated.

In the illustrated circuitry, the input signal is represented by the 13.5 VDC output pulse generated by the General Electric Type 90 decoder mentioned above.

The input signal enters the circuitry through the coupling means 25, FIGS. 7 and 8. The signal is applied to an incandescent lamp 26 and resistor R5 in series. R5 is chosen so that the correct voltage appears across the lamp. Lamp 26 is positioned in front of a photoelectric cell Q2. The photo-electric cell is connected, in series, with resistors R6 and R7, across the 15 VDC produced by the power supply. When an input pulse enters the circuit from the decoder, lamp 26 is lighted. The light falls upon photo-electric cell Q2 and substantially reduces its normally very high resistance, which allows increased current to flow, producing increased voltage across the resistors R6 and R7. While light coupling is presently preferred because it electrically isolates the circuitry from the input source and, most importantly, it eliminates the electrical noise present in the input pulse, it is apparent that the input signal could be introduced directly to the remaining circuitry, bypassing the coupling means altogether, especially when the input signals contain little noise.

The voltage pulse produced at the point between R6 and R7 is applied to the means for generating a first pulse upon initiation of the input pulse and a second pulse upon expiration of the input pulse, indicated generally as the pulse generating means in FIG. 7 and shown as 27 in FIGS. 7 and 8.

This pulse generating means conveniently comprises an integrated circuit, IC3, containing two retriggerable monostable multivibrators. Resistors R8 and R9, capacitors C7 and C8, and diodes D1 and D2 control the duration of the generated pulses. The first generated pulse, preferably a negative pulse, is generated upon the voltage increase across resistor R7, corresponding to the initiation of the input pulse; and the second generated pulse, preferably a positive pulse, is generated upon the voltage decrease across resistor R7, corresponding to the expiration of the input pulse. The first pulse is fed to the timing initiation means 28, FIGS. 7 and 8, and the second pulse is fed to the checking means 29, FIGS. 7 and 8. The timing of the first and second pulses with relation to the input pulse, may be seen by referring to FIG. 9, to the designations input, first pulse, and second pulse.

The regulated 5 VDC produced by IC2 supplies power to IC3, IC4 and IC5.

The timing initiating and reinitiating means 28 consists of a transistor Q3 arranged to ensure that the timer is reset in its timing cycle each time a first pulse is generated. In the present embodiment, where the first pulse is negative, the transistor is of the PNP type. The negative first pulse is directed to both the base of the transistor Q3 and the trigger terminal X3 of IC4. Capacitor C9 is normally held in grounded condition through IC4, however, upon applying a negative pulse to the trigger terminal X3 of IC4, the ground to capacitor C9 is opened. As long as the negative pulse is present on the gate of transistor Q3, the transistor will conduct and essentially ground capacitor C9 to prevent it from charging. The timing is then begun when Q3 is returned to its non-conducting state at the end of the pulse and capacitor C9 is allowed to charge.

The purpose of the timing initiating and reinitiating means is to reset IC4, ensuring a full timing cycle, each time a first pulse is generated. This is done by discharging capacitor C9 through transistor Q3 each time a first pulse is generated. Thus, if two short pulses are spaced closely in time, the first has initiated timing, the second will cause capacitor C9 to be discharged, thus resetting the timing interval, even though this would not be done by IC4 itself with timing already in progress.

The first timing means 30 comprises an integrated circuit timer IC4, resistor R10, variable resistor R11, and capacitor C9, determining the timing interval (leakage through transistor Q3 will also affect the timing interval) output resistor R12, and capacitor C10.

The negative first pulse is applied through the initiating means to the trigger terminal X3 of IC4 which causes the output of IC4 to rise to its high level. The output of IC4 will remain at its high level, after being triggered, until capacitor C9 is charged to a voltage equal to two-thirds the supply voltage, the supply voltage here being the regulated 5 VDC produced by IC2. At the end of the first pulse, transistor Q3 is no longer "on" and capacitor C9 begins to charge through resistors R10 and R11. R11 can be varied to vary the time constant. When the voltage on C9 reaches two-thirds the supply voltage, the output IC4 decreases to its low level. The total time delay from the initiation of the first pulse is the length of the first pulse plus the time required for capacitor C9 to charge to two-thirds of the supply voltage.

Capacitor C10 is a filter capacitor for IC4.

The second timing means 31, comprises a second integrated circuit timer IC5, similar to IC4, resistors R13, variable resistor R14 and capacitor C11 determining the time delay, input capacitor C12 and resistor R15, and capacitor C13. The output of the first timer is coupled to the second timer through capacitor C12 and resistors R12 and R15. When the output of the first timer goes from its high level to its low level, a negative pulse is produced at the trigger terminal X4 of IC5 by reason of the arrangement of R12, R15, and C12.

The negative pulse applied to the trigger of IC5 initiates timing and causes the output of IC5 to go to its high state. This high state is used as the output signal for the second timer. The duration of this positive pulse is determined by resistor R13, variable resistor R14 and capacitor C11. When capacitor C11 is charged to two-thirds the supply voltage, the output of IC5 goes to its low level, and C11 is discharged and held discharged until IC5 is again triggered by a negative pulse. The positive pulse output of the second timer determines the maximum and minimum time duration limitations of the circuit. The start of the positive pulse determines the minimum value and the end of the pulse determines the maximum value.

The output of the second timer is connected to the checking means, which in the presently preferred embodiment is an SCR, Q4. The timed pulse from the second timer is applied to the anode of the SCR while the second pulse from the pulse generating means is applied to the gate. Thus, when the two signals (timed pulse and second pulse) are simultaneously present at the checking means, it will conduct. Thus, if both signals are present at the SCR, the SCR will be turned on and current will flow through it. If only the timed pulse is present at the anode, the SCR will not conduct because gate current is needed to place it in its conducting state. If only the second signal is present on the gate, although it will be in its conducting state, no current will flow from the anode because, without the timed pulse present, there is no potential on the anode. Although an SCR is used in the illustrated circuitry, many other arrangements could be used such as a conventional AND gate, so that an output signal is produced by the circuitry only when both the timed pulse and the second pulse are at some point simultaneously present at the checking means.

It is presently preferred and illustrated that the output of the circuit be light coupled to any circuitry to be operated by the output. Thus, output means 32 in FIG. 8, includes light coupling means, shown as IC6, which is an encapsulated light emitting diode and phototransistor, available commercially as such an encapsulated package. IC6 is shown connected in series with the output of the second timer and input of the checking means. Thus, when the SCR of the checking means allows current to flow from the second timing means, current also flows through the light emitting diode of IC6, causing such diode to emit light, the current is limited by resistor R16. The emitted light is picked up by the phototransistor of IC6, which then conducts, producing an output signal for the circuit.

The illustrated output means, in addition to IC6, includes resistors R17, R18, R19, and R20, capacitors C14 and C15, diode D3 and SCR Q5. Power for the output means is provided directly from transformer T1 and is 12.5 VAC. Diode D3 provides half-wave rectification to the phototransistor of IC6, and acts to separate the ground of the output circuitry from that of the timing circuitry. Capacitor C14 serves to smooth the half-wave ripple and supply 15 VDC. R17 bleeds capacitor C14. When the phototransistor in IC6 begins to conduct, a voltage appears across R18, and is applied to the gate of SCR Q5. R19 limits the current flow through the SCR gate. When the current flows to the gate of Q5, Q5 is placed in "on" condition and will conduct half-waves from the power supply. This produces a voltage across R20, which provides a half-wave rectified output which may be used to activate a relay or other output device. Capacitor C15 acts as a filter for the output and tends to smooth the half-wave rectified output voltage.

Referring to FIG. 9, the sequence of operation of the circuit may be followed. Line 1 shows the input pulse to the system. Line 2 the first pulse and line 3 the delaying pulse. The first pulse is generated upon initiation of the input pulse. The delaying pulse begins with a first pulse and ends a predetermined delay time later. The timed pulse begins at the end of the delaying pulse and marks the minimum limit the input must meet. The end of the timed pulse marks the maximum limit. The first input pulse is shown as short, clearly not meeting the minimum time duration requirements for a desired pulse. The second pulse occurs at the end of the input pulse. Since the timed pulse and the second pulse must appear simultaneously to produce an output, no output is produced by either the timed or second pulse generated by the first input pulse.

The second input pulse shown is also shorter than the minimum. Here, however, another input pulse is shown before completion of the delaying pulse. Although the delaying pulse has been generated, it is reset and will last the preset time from the end of the first pulse generated by the third input pulse. The third input pulse is a correct input and falls within the maximum and minimum limitations. Thus, the timed pulse generated at the end of the delaying pulse appears simultaneously with the second pulse produced by the third input pulse and an output pulse is generated.

The situation where an input pulse is longer than the maximum time limitation is not shown but follows obviously from what is. The timed pulse is generated and ends, and later the second pulse is generated at the end of the long input. Since the two do not coincide, no output is generated.

As here described and illustrated, the circuit is preferably adjusted to respond to pulses fed to it that are between 9.2 and 11.1 seconds in duration. Because of various delays present in the receiver between detection of a transmission and presentation of a corresponding pulse to the circuitry herein described and lesser delays upon ending the transmission, the actual 2100 Hz tone signal on the transmission must be between 10.2 and 12.2 seconds for the circuit to respond. To achieve the 9.2 to 11.1 second timing in the circuitry, the delaying pulse must last for 9.2 seconds at which time the timed pulse is generated which lasts 1.9 seconds. Also, as presently arranged, the first and second pulses last a period of 0.9 seconds, Shorter pulses could obviously be used, but these lengths appear to ensure satisfactory operability of the output when a relay is used, and provide overall timing stability of the circuit.

It will be obvious to one skilled in the art that a wide range of timing intervals can be used and that the various pulse lengths described can be changed considerably.

If only one transmitter is used and no second tone frequency is superimposed upon the transmitted signal by the transmitter, the output of the time gate may be connected directly to the alarm means so as to activate an alarm if an output from the time gate is present.

Figure 6:
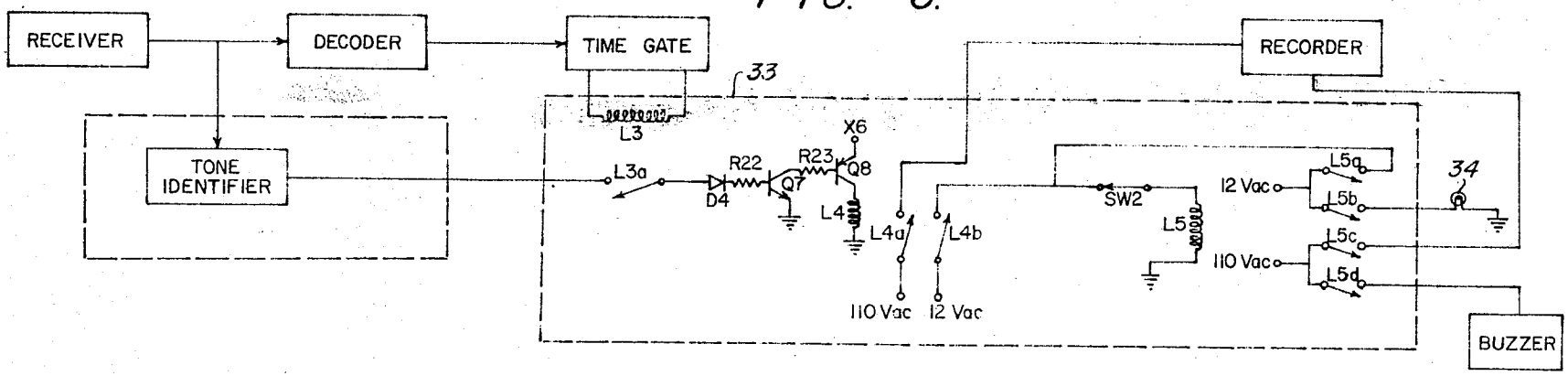

Usually, however, where several transmitters are used and the transmitters superimpose a second tone frequency upon the transmitted signal, the output from the time gate will be sent to an alarm activation means. Presently, it is preferred that this means take the form of a multi-contact relay 33 as shown in FIGS. 5 and 6. The number of relay contacts will be at least equal to the number of different second tone frequencies used in the system, and is shown here as three sets of contacts, L3*a*, L3*b*, and L3*c*, corresponding to the number of transmitters shown in FIG. 1. The time gate output is connected to the relay coil L3 so that upon an output signal from the time gate, the normally open-relay contacts, L3*a*, L3*b* and L3*c*, are closed.

Each set of relay contacts is connected through a transistor Q6 to an individual standard tone identifier such as a General Electric Model 7646. Again, there are provided as many individual tone identifiers as are provided transmitters superimposing different second tone frequencies, the number three being shown. The group of individual identifiers together with their respective transistors Q6 and resistors R21 are referred to collectively as tone identifier in FIG. 1. EAch individual identifier is set to produce an output signal if a particular second tone frequency signal is present on the transmitted signal. If the second tone frequencies superimposed by the transmitters shown In FIG. 1 are 100 Hz, 200 Hz and 300 Hz, respectively, then the three identifiers shown in FIG. 5 would be set to respond to frequencies of 100 Hz, 200 Hz and 300 Hz, respectively. Thus, if one of these frequencies is present on a received transmission, the appropriate identifier will produce an output.

The output of the identifier is connected to the base of a corresponding transistor Q6. When an output signal appears, the corresponding transistor is thereby placed in its conducting condition, allowing current to flow from a positive power source, not shown, connected to its collector terminal X5, causing a voltage across corresponding resistor R21. This voltage appears on one contact of one set of contacts of relay 33. For example, if a 100 Hz signal is present, an output would be given by the first identifier. The closing of the relay points completes a circuit between the voltage caused by the output of the identifier and an appropriate standard latching relay that once energized, remains so, until reset manually by the appropriate reset switch. The latching relay energizes an alarm which usually will be a series of lights, one light corresponding to a particular identifier, and an audible alarm such as a buzzer or bell. The audible alarm draws the attention of the personnel in the alarm center, while the particular light energized will tell such personnel exactly which transmitter has transmitted the alarm signal, and thus, which area of the mine has become unstable.

A recorder may also be connected to the alarm means to provide a permanent record of the alarms received.

A schematic of a portion of one row of the blocks of FIG. 5 is shown in FIG. 6. When an output signal is present from the time gate, energizing relay coil L3 closing relay contacts L3*a*, and an output is present from the identifier, the output of the identifier (the voltage across R21, FIG. 5) is connected through closed relay contacts L3*a* and through diode D4 and current limiting resistor R22 to the base of transistor Q7. This places Q7 in its conducting state and causes a current to flow from the base of transistor Q8 through current limiting resistor R23 placing Q8 in its conducting condition. With Q8 conducting, current flows from a 12 VDC supply connected to terminal X6 through Q8 and through relay coil L4, closing normally open relay contacts L4*a* and L4*b*. The closing of relay contact L4*a* connects a 110 VAC supply to channel recording pen in a standard event recorder such as a Simpson Model 2755. A separate pen will be provided for each identifier, or each row of FIG. 5. The closing of relay contact L4*b* connects a 12 VAC supply through reset switch SW2 to relay coil L5, causing energization of same. The energization of relay coil L5 causes normally open relay contacts L5*a*, L5*b*, L5*c* and L5*d* to close. Relay contact L5*a* connects a 12 VAC supply through reset switch SW2 and relay coil L5, setting up a latching loop which keeps relay coil L5 energized until switch SW2 is opened to reset the relay. Relay coil L4 is energized only during the period of time when both an output from the time gate and from the identifier are present simultaneously, but once relay coil L5 is energized, it remains so because of its latching loop, until reset manually by opening reset switch SW2.

The closing of relay contact L5*b* connects the 12 VAC supply to light 34, causing it to light. A separate light is provided for each row in FIG. 5, each light being labeled so that identification of the identifier producing the output is known, and thus, the particular transmitter sending the signal indicating instability is known.

The closing of relay contact L5*c* connects a 110 VAC supply to the motor portion of the recorder causing the chart to move (the indication of an alarm on the chart is provided by the energization of the recording channel by relay contact L4*a* as described above, such recording channel thereby being energized only momentarily).

The closing of relay contact L5*d* connects a buzzer to the 110 VAC supply causing an audible alarm to be given. Both the buzzer and the recorder motor are common to all rows of FIG. 5. Thus, the relay contacts L5*c* and L5*d* of all corresponding relays in the system (the number of such relays is the same as the number of individual identifiers, for example, three such relays would be used for the system shown in FIG. 5) are connected, respectively, in parallel so that energization of any one of the relays will energize the buzzer and recorder motor. It is remembered, however, that each corresponding relay contact L4*a* and L5*b* operate separate recorder channels and separate lights 34 respectively. In this way, the same audible alarm is given, and the same recorder motor is energized, for any alarm signal received by the system, but only a particular light and recorder channel are energized, indicating from which area of the mine the alarm signal is being received. The recorder will produce a permanent record of all alarms received and from which area of the mine received.

While the invention has been illustrated and described herein with respect to the best mode presently contemplated for use in open-pit mining operations, it will be realized that variations may be made without departing from the inventive concepts herein disclosed and that there are many uses for the system apart from those of the mining industry and that the signal-identifying system can be used in telemetry systems in general.

We claim:

1. A telemetry alarm system adapted to monitor earth slope stability and to provide an alarm upon the occurrence of earth slope instability, comprising earth slope stability sensing means; means for transmitting electrical signals; timing means connected to said sensing means and said transmitting means and adapted to cause the transmitting means to transmit a signal of predetermined time duration and predetermined carrier and tone frequencies upon the sensing of an unstable condition; receiver means adapted to receive signals transmitted by the transmitting means; decoding means into which received signals are passed to produce corresponding pulses of durations of respective predetermined tone frequency signals received; time gate means into which said pulses are passed for determining if the respective pulses are within preset maximum and minimum duration limits and for providing an output when a pulse is within said limits; alarm means; alarm activating means responsive to output from said time gate means; and means for providing power to the system.

2. A telemetry alarm system according to claim 1, wherein the transmitting means is adapted to superimpose a second signal of predetermined tone frequency upon the signal transmitted; and wherein the system additionally includes indentification means electrically connected to the receiver means and responsive to the second superimposed frequency to produce an output; and wherein the alarm activating means is electrically connected to both the time gate means and the indentification means and adapted to activate the alarm means only if an output signal from both the identification means and the time gate means are present.

3. A telemetry alarm system according to claim 2, wherein there are provided a multiplicity of associated slope stability sensors, timing means, and transmitter means, each transmitter means being adapted to superimpose a second tone signal of different predetermined frequency upon the signal transmitted; an equal multiplicity of identification means, each being adapted to identify one of the different second tone frequency signals from one of the multiplicity of transmitter means; an equal multiplicity of alarm means; and an equal multiplicity of alarm activating means electrically connected to both one of the identification means and the time gate means and adapted to operate one of the alarm means, the particular alarm means thus indicating which stability sensor has triggered the alarm.

4. A telemetry alarm system according to claim 2, wherein the time gate means comprises the following: a source of power; means for generating a first pulse upon the initiation of a pulse from the decoding means and for generating a second pulse upon expiration of a pulse from the decoding means; means for coupling the pulse from the decoding means to said means for generating said first pulse and said second pulse; a first timing means adapted to produce a delaying pulse lasting a predetermined time after timing is initiated or reinitiated; means responsive to said first pulse for initiating or reinitiating said first timing means; second timing means responsive to the ending of said delaying pulse and adapted to produce a timed pulse; checking means responsive only to the simultaneous presence of said second pulse and said timed pulse; and output means responsive to said checking means.

5. A telemetry alarm system according to claim 4, wherein the output means of the time gate is light-coupled to the alarm-activating means.

6. A telemetry alarm system according to claim 4, wherein the coupling means utilizes light coupling.

7. A telemetry alarm system according to claim 6, wherein the coupling means comprises a light source and a photo-resistive element in light communication.

8. A telemetry alarm system according to claim 4, wherein the means responsive to the first pulse for initiating or reinitiating the first timing means is a transistor.

9. A telemetry alarm system according to claim 1, wherein the earth slope stability sensing means comprises a support adapted to be placed on stable ground; a base secured to the upper end of the support; a shaft mounted on the base; a pulley secured to the shaft and having transversely extending grooves about its outer circumference; a stake located in unstable ground; a weight; a length of flexible cord, one end of which is secured to the stake and the other end to the weight, the cord being arranged so that an intermediate portion is wound partially around the pulley so that any movement of the stake longitudinally of the cord moves the cord longitudinally and rotates the pulley correspondingly; and a stationary, two-position, microswitch having a roller portion and arranged so that said roller portion rides against a portion of the outer circumference of the pulley, so that the switch is held in one position until a groove is encountered, and so that movement of the roller into the groove places the switch in the other of its positions.

10. A method of monitoring earth slope stability in electrically noisy areas utilizing a stake driven into an earth slope to be monitored and a cable attached to the stake and running to a movable device mounted on stable ground, which movable device is connected with a telemetry system, said method comprising transmitting electrical signals, including a timed tone pulse and a second tone pulse, on a carrier frequency incrementally in accordance with movement of said device whenever the ground in which said stake is driven slides a given distance that constitutes an increment on which operation of said device is based; and actuating an alarm in accordance with received signals which have the proper timed and second tone pulses.

11. A method of monitoring earth slope stability according to claim 10, wherein a plurality of earth slope stability monitors are utilized, second tone pulse being different for each stability monitor, wherein the alarm is activated in accordance with received signals which have the proper timed and second tone pulses, and wherein the second tone pulse provides an indication of which sensor transmitted the signal.

12. An earth slope stability sensor, comprising a support adapted to be placed on stable ground; a base secured to the upper end of the support; a shaft mounted on the base; a pulley secured to the shaft and having transversely extending grooves about its outer circumference; a stake located in unstable ground; a weight; a length of flexible cord, one end of which is secured to the stake and the other end to the weight, the cord being arranged so that an intermediate portion is wound partially around the pulley so that any movement of the stake longitudinally of the cord moves the cord longitudinally and rotates the pulley correspondingly; and a stationary, two-position, micro-switch having a roller portion and arranged so that said roller portion rides against a portion of the outer circumference of the pulley and so that the switch is held in one position until a groove is encountered and movement of the roller into the groove places the switch in the other of its positions.

* * * * *